US011421534B2

(12) United States Patent
Joly et al.

(10) Patent No.: US 11,421,534 B2
(45) Date of Patent: Aug. 23, 2022

(54) DAMPING DEVICE

(71) Applicant: SAFRAN AIRCRAFT ENGINES, Paris (FR)

(72) Inventors: Philippe Gerard Edmond Joly, Moissy-Cramayel (FR); Francois Jean Comin, Moissy-Cramayel (FR); Laurent Jablonski, Moissy-Cramayel (FR); Romain Nicolas Lagarde, Moissy-Cramayel (FR); Jean-Marc Claude Perrollaz, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 286 days.

(21) Appl. No.: 16/221,363

(22) Filed: Dec. 14, 2018

(65) Prior Publication Data

US 2019/0186270 A1 Jun. 20, 2019

(30) Foreign Application Priority Data

Dec. 18, 2017 (FR) ..... 1762358

(51) Int. Cl.
*F01D 5/10* (2006.01)
*F01D 5/22* (2006.01)
(Continued)

(52) U.S. Cl.
CPC ..... *F01D 5/10* (2013.01); *F01D 5/22* (2013.01); *F01D 5/26* (2013.01); *F04D 29/324* (2013.01);
(Continued)

(58) Field of Classification Search
CPC ..... F01D 5/10; F01D 5/22; F01D 5/26; F01D 11/005; F01D 15/16; F01D 25/04;
(Continued)

(56) References Cited

U.S. PATENT DOCUMENTS 2,999,668 A 9/1961 Howald et al.
4,478,554 A * 10/1984 Surdi ..... F01D 5/323 416/220 R
(Continued)

FOREIGN PATENT DOCUMENTS

EP 1985810 A1 10/2008
FR 2923557 5/2009
(Continued)

OTHER PUBLICATIONS

"Merriam-Webster, Ferrule, https://www.merriam-webster.com/dictionary/ferrule" (Year: 2016).*
(Continued)

*Primary Examiner* — Aaron R Eastman
(74) *Attorney, Agent, or Firm* — Womble Bond Dickinson (US) LLP

(57) ABSTRACT

An assembly for a turbomachine including a first rotor module (2) with a first blade (20), and a second rotor module (3), connected to the first rotor module (2). The second rotor module includes a second blade with a smaller length than the first blade (20). A damping device (4) is attached to the second rotor module (3) and includes a radial external surface (40) supported with friction against the first module (2), so as to couple the modules (2, 3) for the purpose of damping their respective vibrational movements during operation.

15 Claims, 11 Drawing Sheets

Figure 1:
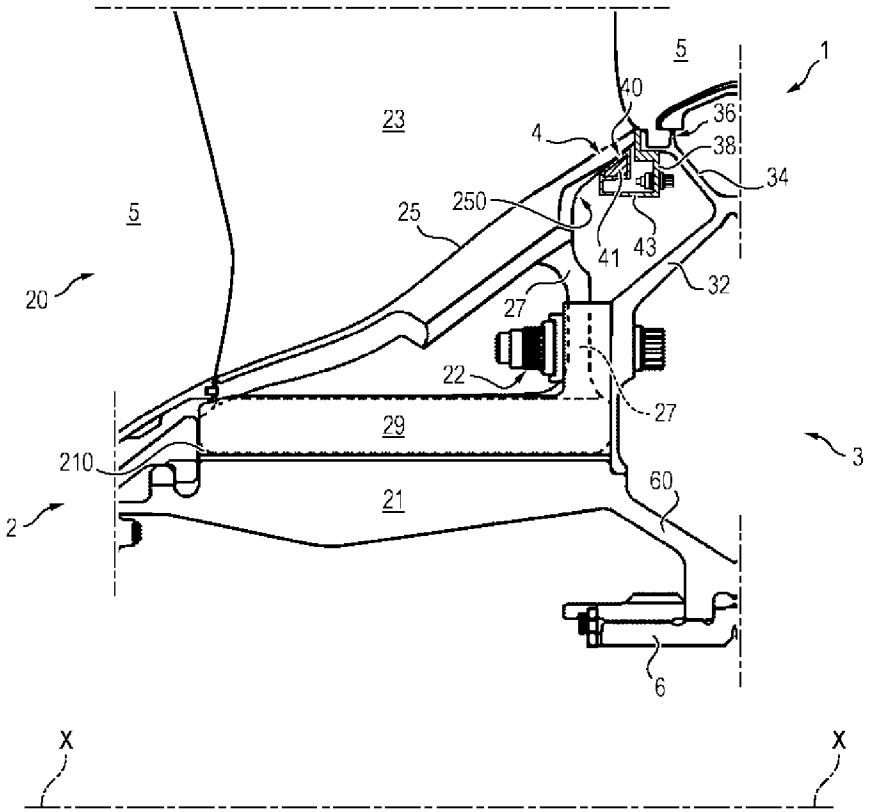

(51) Int. Cl.
*F04D 29/32* (2006.01)
*F04D 29/66* (2006.01)
*F01D 5/26* (2006.01)

(52) U.S. Cl.
CPC ..... *F04D 29/668* (2013.01); *F05D 2260/96* (2013.01)

(58) Field of Classification Search
CPC ..... F01D 25/06; F04D 29/324; F04D 29/668; F04D 29/663; F05D 2260/96; F05D 2300/43; F05D 2230/90
USPC ..... 416/193 A, 190, 500
See application file for complete search history.

(56) References Cited

U.S. PATENT DOCUMENTS 4,604,033 A * 8/1986 Surdi ..... F01D 5/323 416/220 R
4,723,889 A 2/1988 Charreron et al.
5,205,713 A 4/1993 Szpunar et al.
5,820,346 A * 10/1998 Young ..... F01D 5/22 416/193 A
6,595,755 B2 * 7/2003 Brioude ..... F01D 5/323 416/220 R
7,458,769 B2 * 12/2008 Forgue ..... F01D 5/26 415/119
9,371,742 B2 * 6/2016 Belmonte ..... F01D 11/005
10,415,424 B2 * 9/2019 Le Strat ..... F01D 9/02
2007/0020089 A1 * 1/2007 Forgue ..... F01D 5/326 415/119
2009/0123286 A1 5/2009 Mace et al.
2011/0052398 A1 * 3/2011 Fulayter ..... F01D 5/16 416/219 R
2012/0141296 A1 6/2012 Bilz et al.
2016/0032734 A1 * 2/2016 Delapierre ..... F01D 5/22 60/200.1
2019/0186270 A1 * 6/2019 Joly ..... F01D 5/10
2021/0079794 A1 * 3/2021 Joly ..... F01D 5/22

FOREIGN PATENT DOCUMENTS

FR 2949142 2/2011
FR 3047512 A1 8/2017
GB 0670665 A 4/1952

OTHER PUBLICATIONS

Preliminary Research Report received for French Application No. 1762358, dated Jul. 31, 2018, 3 pages (1 page of French Translation Cover Sheet and 2 pages of original document).

* cited by examiner

DAMPING DEVICE

TECHNICAL FIELD

The invention relates to an assembly comprising a turbomachine rotor module.

The invention relates more specifically to an assembly for a turbomachine comprising two rotor modules and a damping device.

PRIOR ART

A turbomachine rotor module generally comprises one or more stage(s), each stage comprising a disk centered on a turbomachine longitudinal axis, corresponding to the axis of rotation of the rotor module. The rotation of the disk is generally ensured by a rotating shaft to which it is integrally connected, for example by means of a rotor module trunnion, the rotating shaft extending along the longitudinal axis of the turbomachine. Blades are mounted on the external periphery of the disk, and distributed circumferentially in a regular manner around the longitudinal axis. Each blade extends from the disk and also comprises an airfoil, a platform, a support and a root. The root is embedded in a recess of the disk configured for this purpose, the airfoil is swept by a flow passing through the turbomachine and the platform forms a portion of the internal surface of the flow path.

The range of operation of a rotor module is limited particularly due to aeroelastic phenomena. The rotor modules of modern turbomachines, which have a high aerodynamic loading and a reduced number of blades, are more sensitive to this type of phenomena. In particular, they have reduced margins between the zones of operation without instability and the unstable zones. It is nevertheless imperative to guarantee a sufficient margin between the stability range and that of instability, or to demonstrate that the rotor module can operate in the instability range without exceeding its endurance limit. This allows guaranteeing risk-free operation over the entire range of operation of the turbomachine.

Operation in the zone of instability is characterized by coupling between the fluid and the structure, the fluid contributing energy to the structure, and the structure responding with its natural modes a levels which can exceed the endurance limit of the material constituting the blade. This generates vibrational instabilities which accelerate the wear of the rotor module and reduce its lifetime.

In order to limit these phenomena, it is known to implement a system damping the dynamic response of the blade, so as to guarantee that it does not exceed the endurance limit of the material regardless of the operating point of the rotor module. However, most of the known systems of the prior art are dedicated to damping vibration modes with non-zero dephasing, and characterizing an asynchronous response of the blades to aerodynamic forces. Such systems have for example been described in documents FR 2 949 142, EP 1 985 810 and FR 2 923 557, in the Applicant's name. These systems are all configured to be accommodated between the platform and the root of each blade, in the recess delimited by the respective supports of two successive blades. Moreover, such systems operate, when two successive blade platforms move with respect to one another, by dissipation of the vibration energy, for example by friction.

However, these systems are completely ineffective for damping vibration modes having zero dephasing involving the blades and the rotor line, i.e. its rotating shaft. Such modes are characterized by a flexure of the rotor blades with a zero inter—blade dephasing, involving a non-zero moment on the rotating shaft. In addition, this is a coupled mode between the blade, the disk and the rotating shaft. More precisely, the torsion within the rotor module, resulting for example from reverse forces between a turbine rotor and a compressor rotor, lead to flexural movements of the blades with respect to their attachments to the disk. The movements are the greater the larger the blade, and the more flexible the attachment.

There exists therefore a need for a damping system for a turbomachine rotor allowing the instabilities generated by all the modes of vibration as previously described to be limited.

SUMMARY OF THE INVENTION

One goal of the invention is to damp vibration modes with zero dephasing for all types of turbomachine rotors.

Another goal of the invention is to influence the damping of vibration modes with non-zero dephasing, for all types of turbomachine rotors.

Another goal of the invention is to propose a damping solution that is simple and easy to implement.

The invention proposes in particular an assembly for a turbomachine comprising:

- a first rotor module comprising a first blade,
- a second rotor module, connected to the first rotor module, and comprising a second blade of smaller length than the first blade, and
- a damping device attached to the second rotor module and comprising a radial external surface supported with friction against the first module, so as to couple the modules for the purpose of damping their respective vibrational movements during operation.

Mechanical coupling between the first and the second rotor module allows increasing the tangential stiffness of the connection between these two rotors, while allowing a certain axial and radial flexibility of the damping device so as to maximize the contact between the different elements of the assembly. This makes it possible to limit the instabilities connected with the vibration mode with zero dephasing, but also to participate in the damping of the vibration modes with non-zero dephasing. In addition, such an assembly has the advantage of the easy integration within existing turbomachines, either during manufacture or during maintenance. Indeed, the attachment of the damping device on the second rotor module, for example prior to assembling the first rotor module on the second rotor module, avoids assembly maneuvers that are sometimes difficult in restricted zones of the turbomachine.

The assembly according to the invention can also comprise the following features, taken alone or in combination:

- the first rotor module comprises a disk centered on a turbomachine longitudinal axis, the first blade being mounted on the radial external periphery of the disk from which it extends, and further comprising an airfoil, a platform, a support and a root embedded in a recess of the disk, and the second module comprises:
  - a drum comprising a circumferential extension extending toward the platform of the first blade, and
  - a ferrule attached to the protruding extension of the drum, the support surface of the damping device being supported on an internal surface of the platform of the first blade, the damping device being attached to the ferrule, the damping device comprises a head, said head comprising a sacrificial plate, said plate comprising an additional coating defining the support surface, the coating is of the dissipative type, the coating is of the viscoelastic type, the damping device comprises bores designed to lighten the damping device, the damping device comprises inserts, of the metallic type for example, designed to weigh down the damping device, the ferrule comprises axial extensions forming a support so as to limit the tangential movements of the damping device, the ferrule comprises a fixing collar, the damping device comprises a attachment foot connected by bolting to the fixing collar, it also comprises an abutment attached to the bolted connection so as to limit the axial movements of the damping device during operation, this bolted connection operating with the attachment foot connected by bolts to the fixing collar, the fixing collar comprises an opening, the damping device comprising a lug configured to cooperate with the opening so as to attach the damping device to the fixing collar, and the first module is a fan, and the second module a compressor, for example a low-pressure compressor.

The invention also relates to a turbomachine comprising an assembly as described previously.

The invention also relates to a damping device configured to be attached to a second rotor module of an assembly as previously described, and also comprising a radial external surface configured to be supported with friction against a first module of such an assembly, so as to couple the modules for the purpose of damping their respective vibrational movements during operation.

RAPID DESCRIPTION OF THE FIGURES

Figure 2:
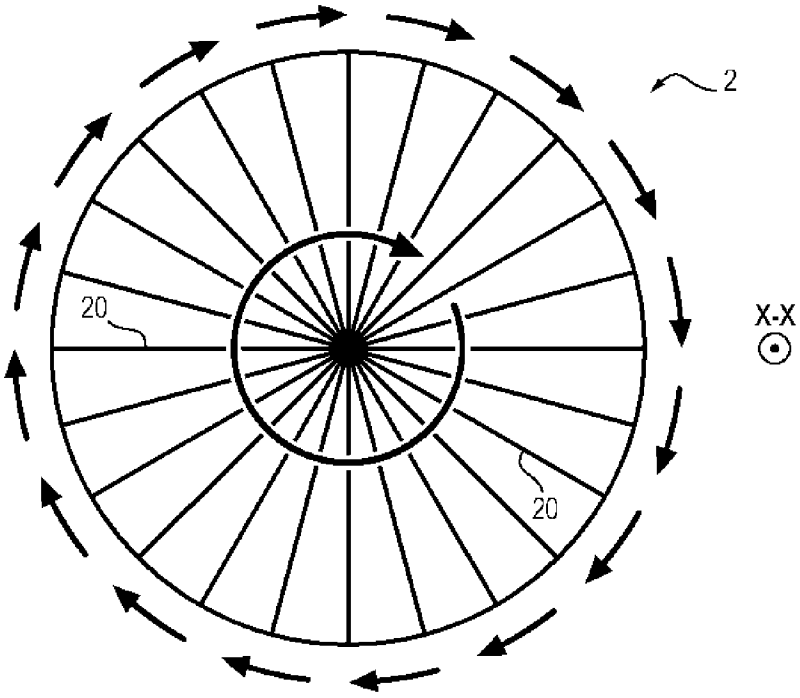
Figure 3A:
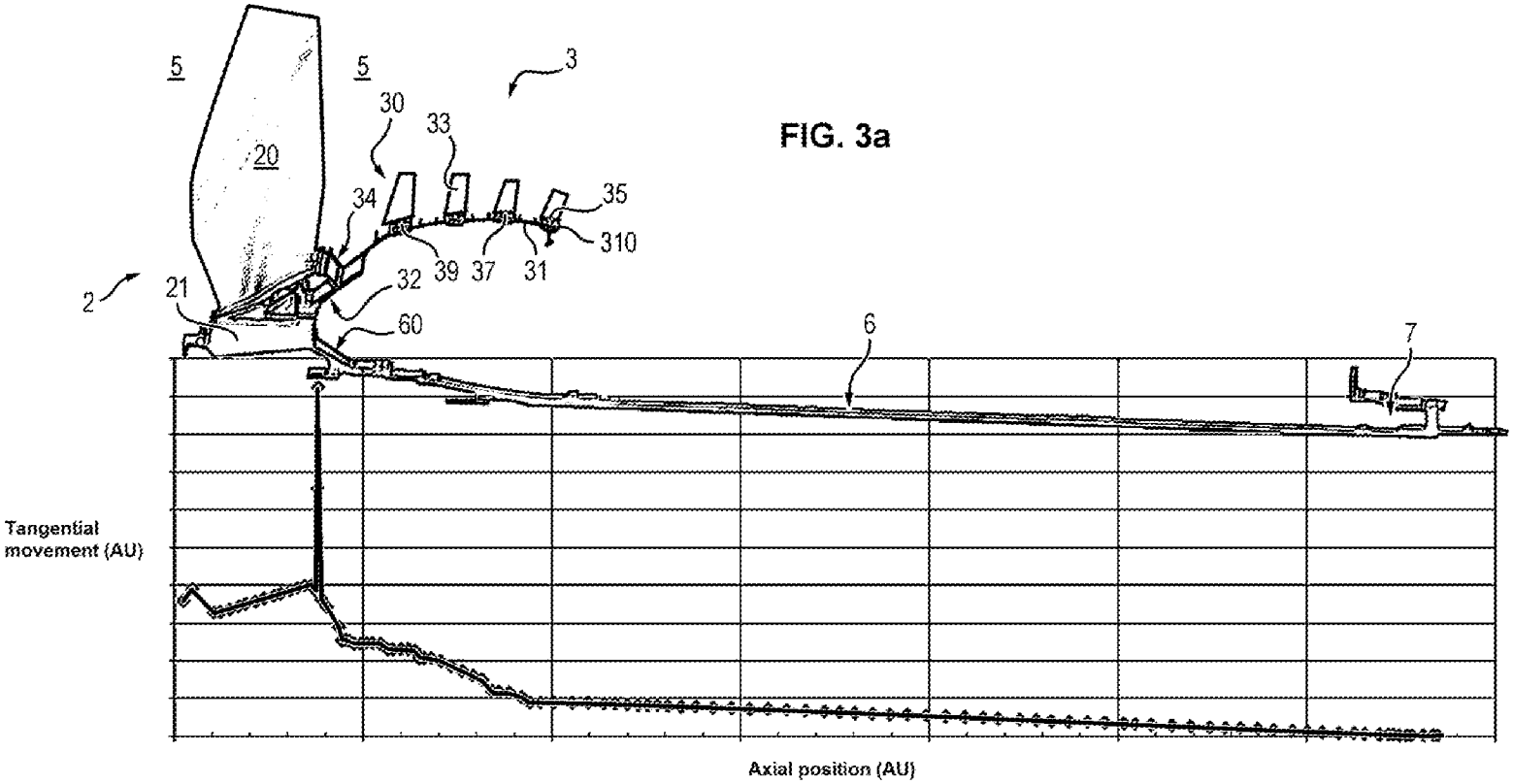
Figure 3B:
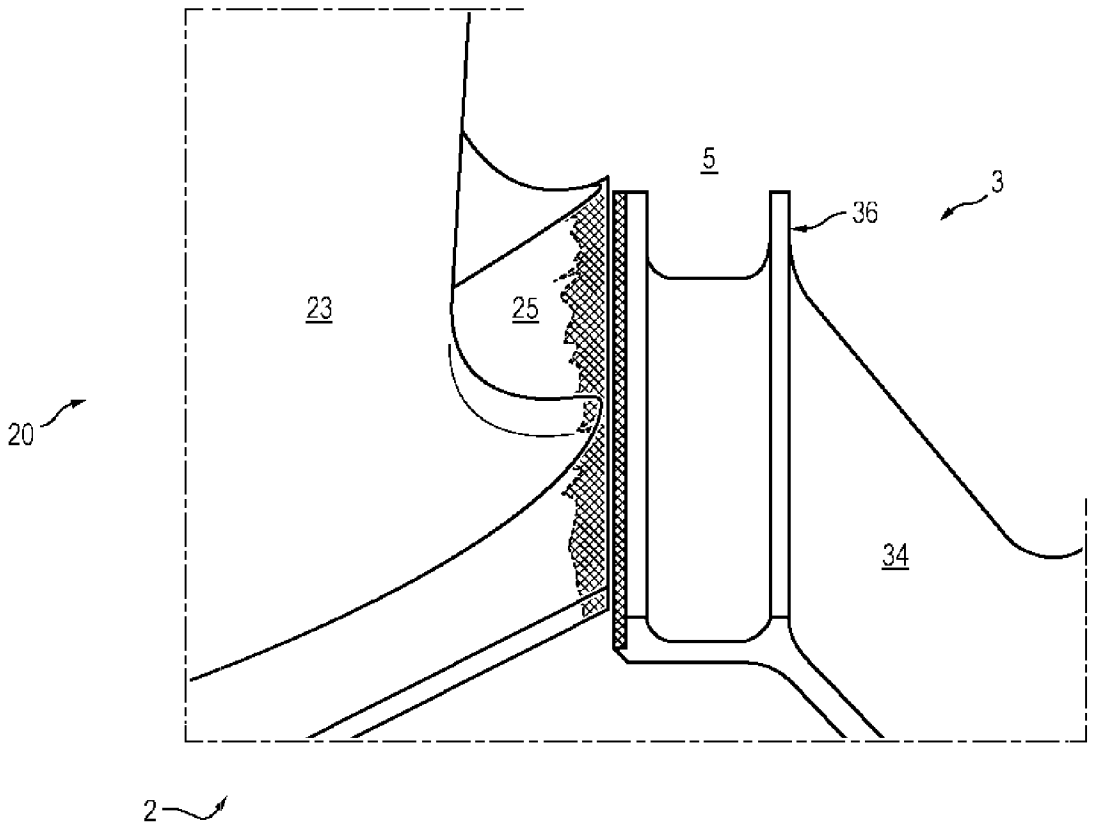
Figure 4A:
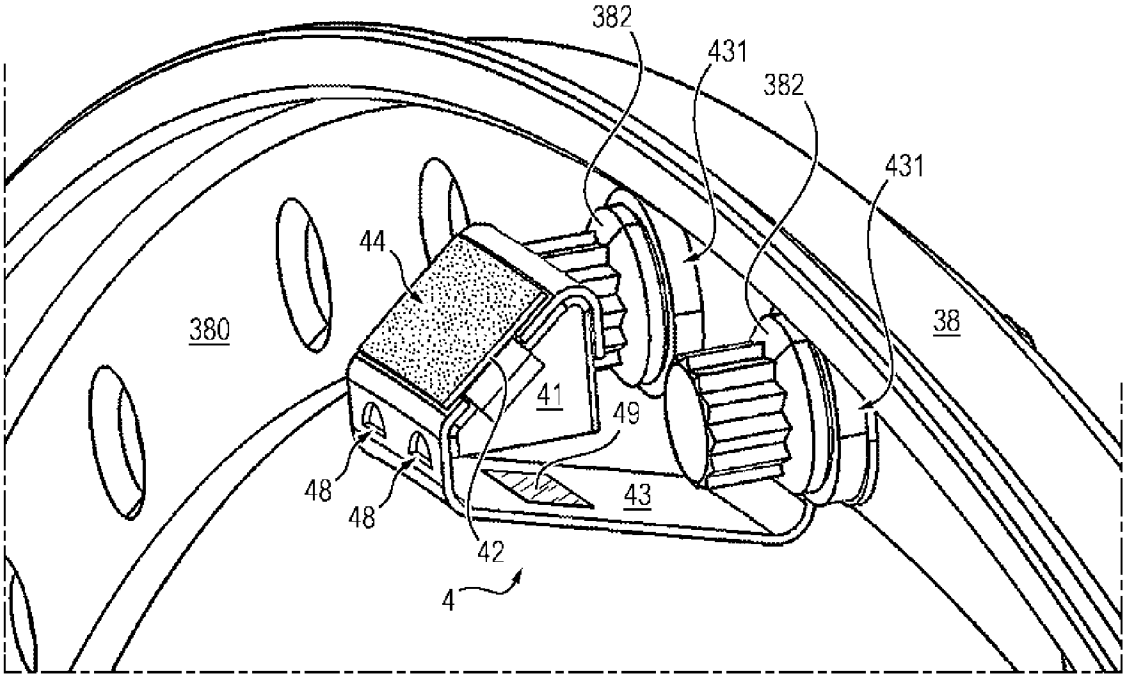
Figure 4B:
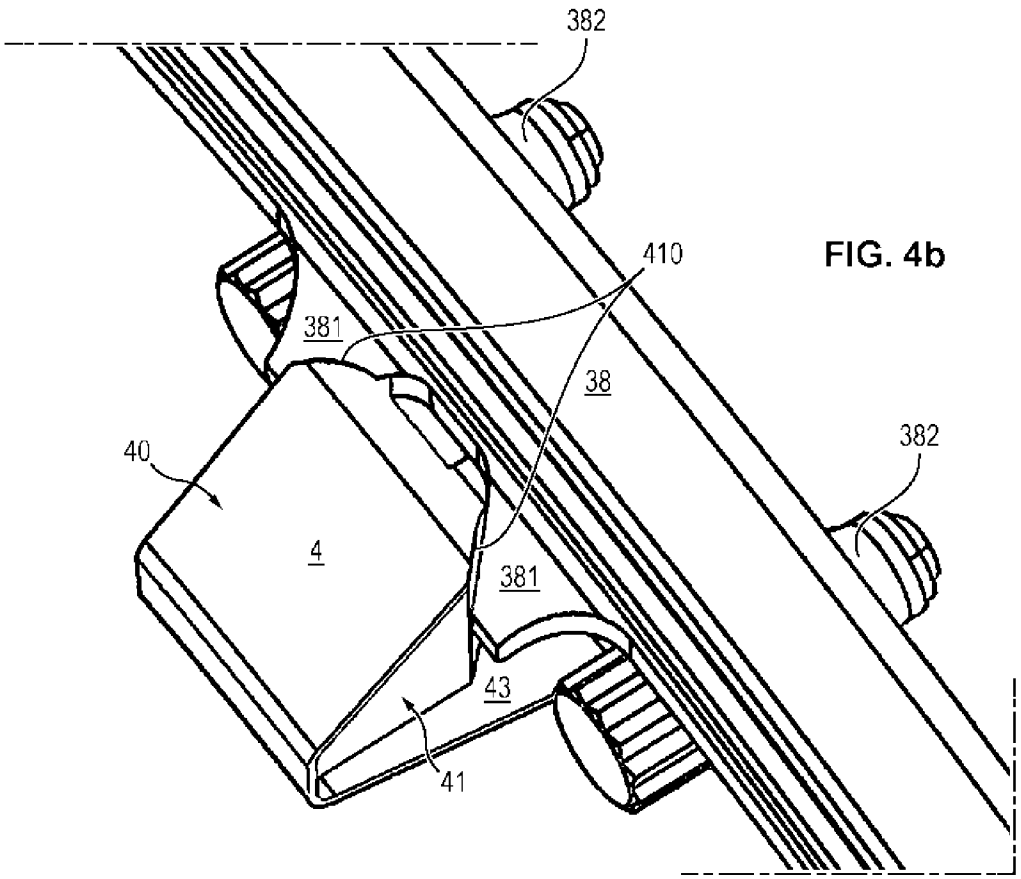
Figure 4C:
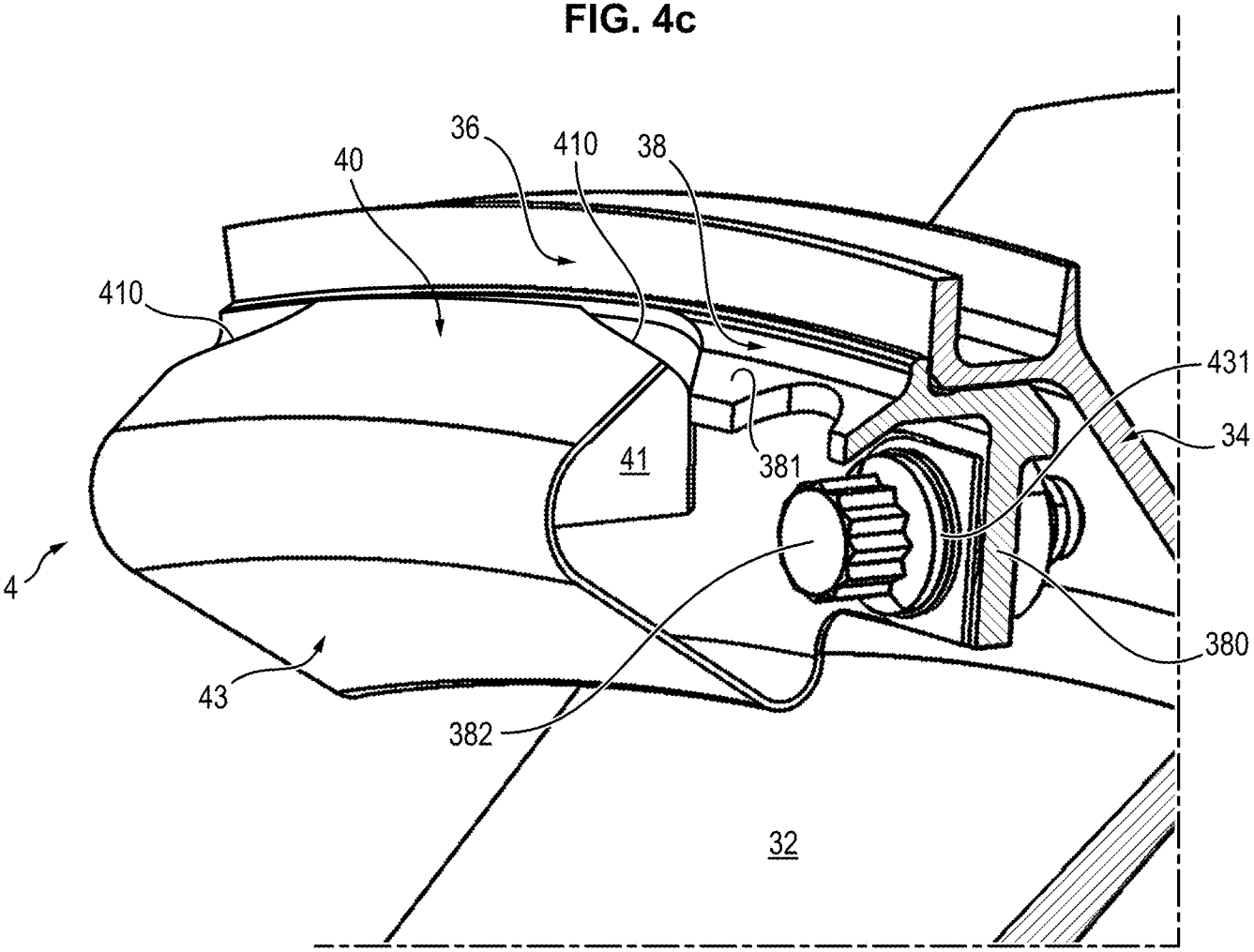
Figure 4D:
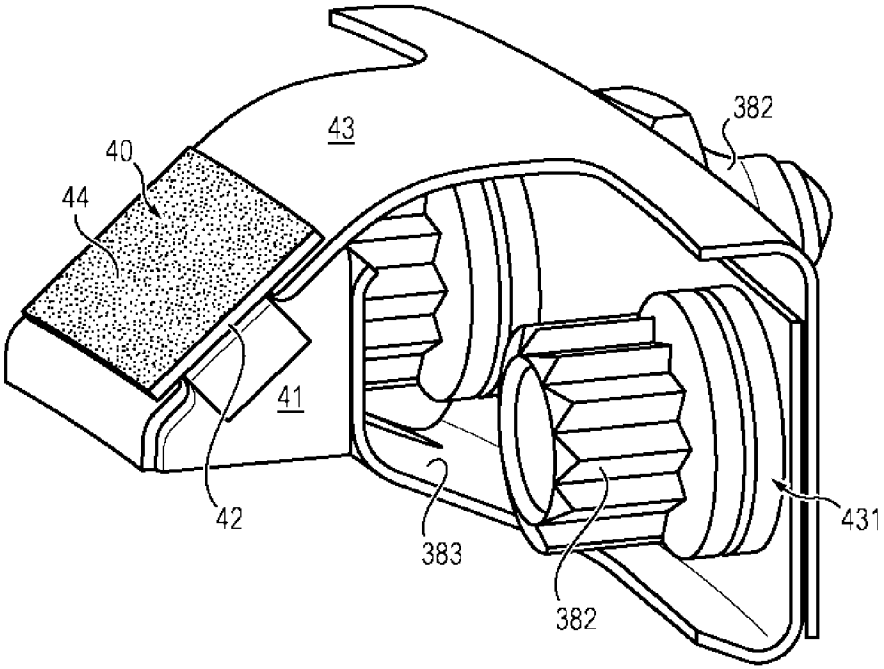
Figure 4E:
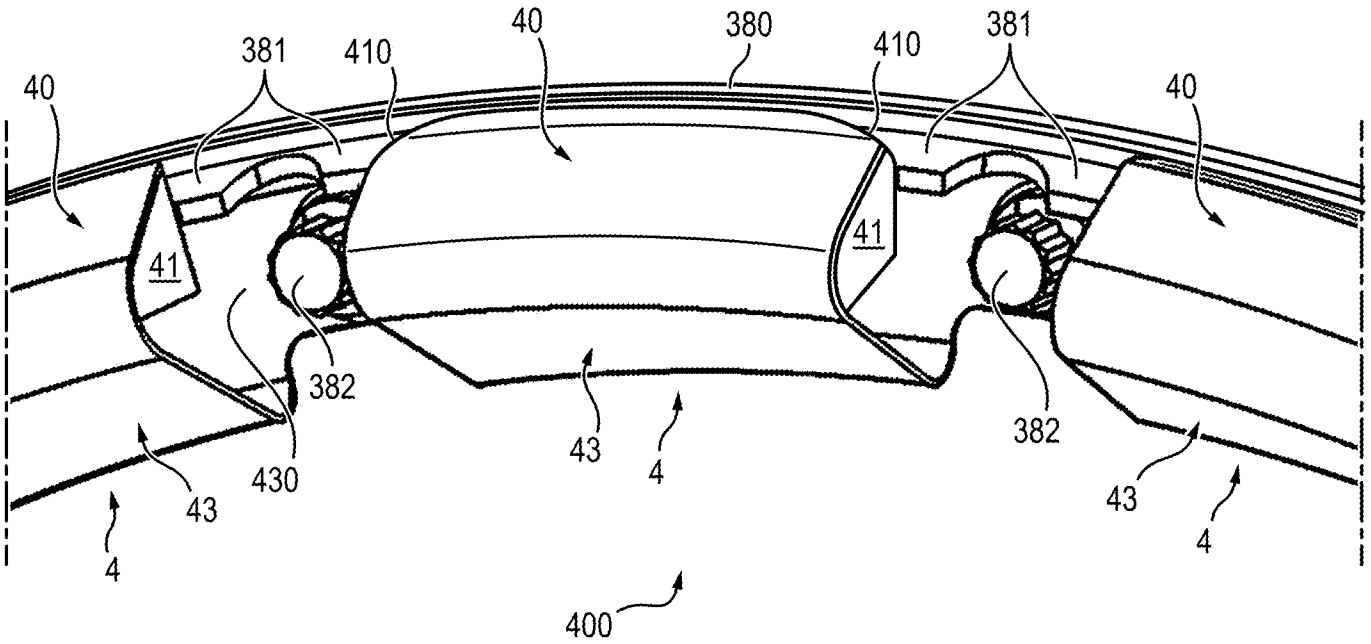
Figure 5A:
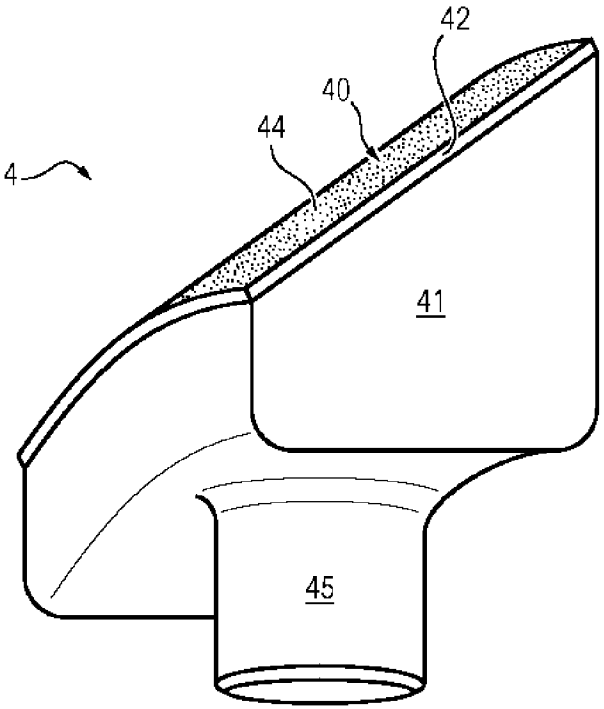
Figure 5B:
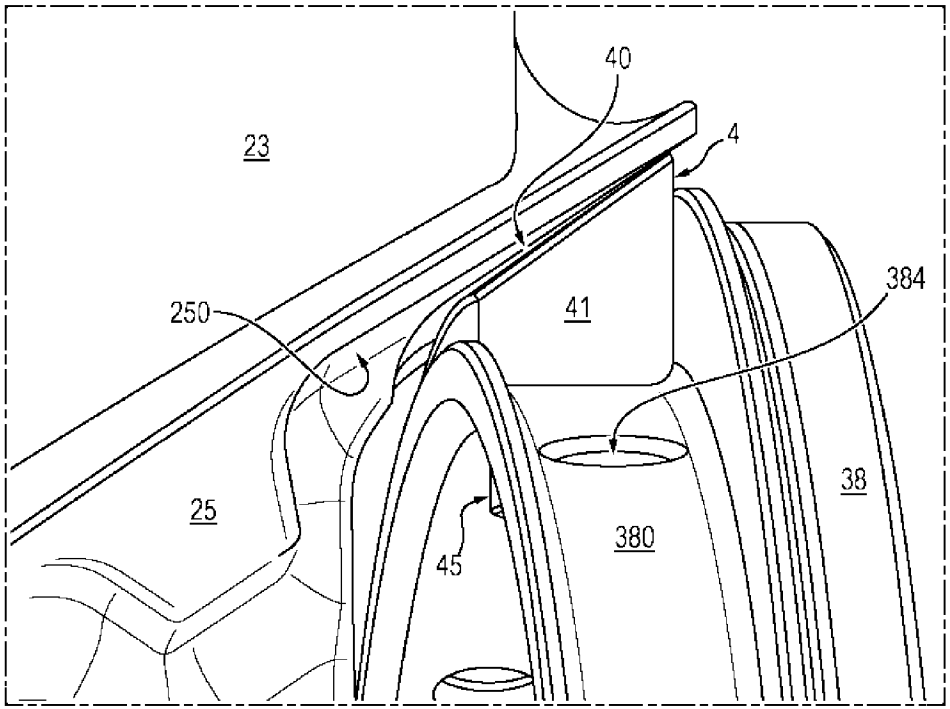

Other features, goals and advantages of the present invention will appear upon reading the detailed description which follows and with reference to the appended drawings given by way of a non-limiting example and in which:

FIG. 1 is a schematic section view of an exemplary embodiment of the assembly according to the invention, FIG. 2 is a front view of a rotor module subjected to tangential vibrations of which the mode has zero dephasing, FIG. 3*a* illustrates schematically the tangential movements of turbomachine rotor modules, as a function of the position of said module along a turbomachine axis, FIG. 3*b* is an enlargement is a schematic enlargement in perspective of the interface between two turbomachine rotor modules illustrated its relative tangential displacements of said rotor modules, FIG. 4*a* illustrates schematically a portion of a first exemplary embodiment of an assembly according to the invention, FIG. 4*b* illustrates schematically a portion of a second exemplary embodiment of an assembly according to the invention, showing in particular radial support extensions, FIG. 4*c* illustrates schematically a portion of a third exemplary embodiment of an assembly according to the invention, close to that illustrated in FIG. 4*b*, FIG. 4*d* illustrates schematically a portion of a fourth exemplary embodiment of an assembly according to the invention, FIG. 4*e* illustrates schematically a portion of a fifth exemplary embodiment of an assembly according to the invention, FIG. 5*a* illustrates schematically an exemplary embodiment of a damping device according to the invention, and FIG. 5*b* illustrates schematically a portion of a fifth exemplary embodiment of an assembly according to the invention, in correspondence with the type of device as illustrated in FIG. 5*a*.

DETAILED DESCRIPTION OF THE INVENTION

One exemplary embodiment of an assembly 1 according to the invention will now be described, with reference to the figures.

Hereafter, upstream and downstream are defined with respect to the normal flow direction of air through the turbomachine. Furthermore, a turbomachine longitudinal axis X-X is defined. In this manner, the axial direction corresponds to the direction of the turbomachine longitudinal axis X-X, a radial direction is a direction which is perpendicular to this turbomachine longitudinal axis X-X and which passes through said turbomachine longitudinal axis X-X, and a circumferential direction corresponds to the direction of a line with a closed planar curve, of which all the points are located at an equal distance from the turbomachine longitudinal axis X-X. Finally, and unless the contrary is stated, the terms "internal (or interior" and "external (or exterior)," respectively, are used with reference to a radial direction so that the internal (i.e. radially internal) portion or face of an element is closer to the turbomachine longitudinal axis X-X than the external (i.e. radially external) portion or face of the same element.

With reference to FIGS. 1 and 3*a*, such an assembly 1 comprises:

a first rotor module 2 comprising a first blade 20, a second rotor module 3, connected to the first rotor module 2 and comprising a second blade 20 with a smaller length than the first blade 20, and a damping device 4 attached to the second rotor module 3, and comprising a radial external surface 40 supported with friction against the first module 1, so as to couple the modules 2, 3 for the purpose of damping their respective vibrational movements during operation.

By support "with friction" is meant that the contact between the external radial surface 40 and the first rotor module 2 is accomplished with friction. In other words, the support forces between the radial external surface 40 and the first rotor module 2 can be decomposed into pressure forces, which are directed normal to the contact, and friction forces, directed tangentially to the contact. This support guarantees both the mechanical consistency of the assembly 1, by means of the pressure forces, but also coupling between the modules 2, 3 for the purpose of damping their respective vibrational movements during operation, by means of friction forces.

With reference to FIGS. 1 and 3*a*, the first rotor module is a fan 2, and the second rotor module is a low-pressure compressor 3, situated immediately downstream of the fan 2.

The fan 2 and the low-pressure compressor 3 comprise a disk 21, 31 centered on a turbomachine longitudinal axis X-X, the first 20 and the second 30 blade being respectively mounted on the external periphery of the disk 21, 31, and also comprising an airfoil 23, 33, a platform 25, 35 a support 27, 37 and a root 29, 39 embedded in a recess 210, 310 of the disk 21, 31. The distance separating the root 29, 39 from the end of the airfoil 23, 33 constitutes the respective lengths of the first 20 and of the second 30 blade. The length of the first blade 20 and second blade 30 is therefore considered here to be substantially radial with respect to the longitudinal axis of rotation X-X of the rotor modules 2, 3. During operation, the airfoil 23, 33 is swept by a flow 5 passing through the turbomachine, and the platform 25, 35 forms a portion of the internal surface of the flow path 5. Generally, as can be seen in FIGS. 2 and 3*a*, the fan 2 and the low-pressure compressor 3 comprise a plurality of blades 20, 30 distributed circumferentially around the longitudinal axis X-X. The low-pressure compressor 3 also comprises a drum 32 also centered on the longitudinal axis X-X. The drum 32 comprises a circumferential extension 34, also annular, extending toward the platform 25 of the first blade 20. This annular extension 34 carries radial knife edge seals 36 configured to prevent losses of air flow rate from the flow path 5. Moreover, the drum 32 is attached to the fan 2 disk 21 by means of attachments 22 distributed circumferentially around the longitudinal axis X-X. Such attachments can for example be bolted connections 22. Alternatively, such attachments 22 can be accomplished by interference fit to which is associated an anti-rotation device and/or an axial locking system. Finally, with reference to FIG. 3*a*, the assembly formed from the fan 3 and from the compressor 3 is rotated by a rotary shaft 6, called the low-pressure shaft, to which the fan 2 and the low-pressure compressor 3 are integrally connected, by means of a rotor trunnion 60, the low-pressure shaft 6 also being connected to a low-pressure turbine 7, downstream of the turbomachine, and extending along the turbomachine longitudinal axis X-X.

In operation, the fan 2 aspires air of which all or part is compressed by the low-pressure compressor 3. The compressed air then circulates in a high-pressure compressor (not shown) before being mixed with fuel, then ignited within the combustion chamber (not shown), to finally be successively expanded in the high-pressure turbine (not shown) and the low-pressure turbine 7. The opposing forces of compression, upstream, and of expansion downstream cause aeroelastic flutter phenomena which couple aerodynamic forces on the blades 20, 30 and vibration movements in flexure and torsion in the blades 20, 30. As illustrated in FIG. 2, this flutter causes in particular intense torsion forces within the low-pressure shaft 6 which are passed on to the fan 2 and to the low-pressure compressor 3. The blades 20, 30 are the subjected to tangential pulses, particularly according to a vibration mode with zero dephasing. This is in fact a flexural mode with zero inter-blade 20, 30 dephasing, involving a non-zero moment on the low-pressure shaft 6, of which the natural frequency is approximately one and a half times greater than that of the first vibration harmonic, and of which the deformation has a nodal line at mid-height of the blade 20, 30. Such vibrations limit the mechanical performance of the fan 2, and of the low-pressure compressor 30, accelerate the wear of the turbomachine and reduce its lifetime.

As can be seen in FIG. 3*a*, the tangential movement of the fan 2 blade 20 is different from that of the first low-pressure compressor 3 drum 32. In fact, the length of the fan 2 blades 20 being greater than that of the low-pressure compressor 3 blades 30, the tangential flexural moment caused by the pulses of a fan 2 blade 20 is much greater than that caused by the pulses of a low-pressure compressor 3 blade 30. In addition, the mounting stiffness within the fan 2 is different from that of mounting within the compressor 3. Referring to FIG. 3*b*, this deviation in tangential pulses is particularly visible at the interface between the platform 25 of a fan 2 blade 20 and the knife edge seals 36 of the drum 32.

In a first embodiment illustrated in FIG. 1, the damping device 4 is accommodated below the platform 35 of a fan 2 blade 20, between the support 27 and the first low-pressure compressor 3 drum 32.

Moreover, the second module 3 comprises a ferrule 38 attached to the protruding extension 34 of the drum 32, by interference fit for example. The damping device 4 is also attached to this ferrule 38. The ferrule 38 can also be assembled to the protruding extension 34 of the drum 32, by means of alternating attachments (not shown) such as those provided by radial fingers which would belong the said ferrule 38 and which would be screwed to said extension 34.

The supporting surface 40 is upstream of the damping device 4, and is supported against the fan 2 at the internal surface 250 of the platform 25 of the fan 2 blade 20.

This assembly ensures tangential coupling with high stiffness between the fan 2 and the low-pressure compressor 3, so as to reduce the tangential vibrations previously described. The coupling, moreover, is stronger as the zone within which the damping device 4 is disposed has greater relative tangential movements for the zero dephasing mode considered, as illustrated in FIGS. 3*a* and 3*b*. Typically, these relative displacements are on the order of a few millimeters. In any case, the damping device 4 also advantageously retains effectiveness on the vibrational modes of the fan 2 blades 20 with non-zero dephasing.

In a second embodiment illustrated in FIGS. 4*a*, 4*d* and 5*a*, the damping device 4 comprises a head 41, said head comprising a sacrificial plate 42 accommodated on the external upstream surface 40 of the damping device 4. This plate 42 is configured to guarantee the support with friction of the support surface 40 of the damping device 4 on the fan 2. Indeed, the mechanical forces during operation are such that slight tangential, axial and radial movements of the damping device 4 should be expected. These movements are in particular due to the tangential pulses to be damped, but also to the centrifugal loading of the assembly 1. It is necessary that these movements do not cause wear on the blades 20, the coatings of which are relatively fragile. In this regard, the sacrificial plate 42 comprises an anti-wear material, for example of the Teflon type, or any specific composite material known to the man skilled in the art. In addition, the sacrificial plate 42 can be treated by dry lubrication, for the purpose of maintaining the value of the friction coefficient between the damping device 4 and the blade 20 platform 25. This lubrication is for example of the MoS2 type.

For the purpose of improving the support with friction of the damping device 4, the sacrificial plate 42 can also comprise an additional coating 44, as can be seen in FIGS. 4*a*, 4*d* and 5*a*. Generally, such a coating 44 is configured to reduce the friction and/or the wear of engine parts between the plate 42 and the rotor modules 2, 3.

This coating 44 is for example of the viscoelastic type. Such a coating 44 then advantageously comprises a material having properties similar to those of a material such as those of the range having the commercial designation "SMACTANE®," for example a material of the "SMACTANE® 70" type. Another means of increasing the tangential stiffness of the assembly 1 is to sufficiently preload the viscoelastic coating 44, for example during assembly of the assembly 1, so that the relative tangential movement between the blade 20 and the drum 32 is transformed into viscoelastic shear of the coating 44 alone.

Alternatively, this coating 44 is of the dissipative and/or viscoelastic and/or damping type. The dissipative coating 44 then comprises a material selected from those having mechanical properties similar to those of Vespel, of Teflon or of any other material with lubricating properties. More generally, the material has a friction coefficient comprised between 0.3 and 0.07. In this manner, the damping device 4 is not too flexible tangentially. Too great a flexibility would not allow the zero-dephasing mode to be damped, because the relative movements of the fan 2 and of the low-pressure compressor 3 would lead to friction and/or oscillations between a "stuck" state and a "sliding" state of the damping device 4.

These additional coatings 44 are applied by gluing to the sacrificial plate 42.

In a third embodiment, illustrated in FIG. 4*a*, the damping by tangential coupling can be adjusted by controlling the mass of the damping device 4, which influences the shear inertial. This control involves modifications of the mass of the damping device 4, for example at the head 41 of the damping device 4. This mass can be modified in all or part of the damping device 4 and/or the head 41, typically by providing bores 48 for lightening, and/or by adding one or more inserts 49, metallic for example, for weighing down.

Advantageously, the combination of the second and third embodiment allows adjusting the contact forces between the damping device 4 and the fan 2. In fact, contact forces that are too high between the fan 2 blade 20 and the damping device 4 would limit the dissipation of vibrations during operation.

In another embodiment, with reference to FIGS. 4*b*, 4*c* and 4*e*, the ferrule 38 of the second module comprises axial extensions 381 forming a support so as to limit the tangential movements of the damping device 4 during operation.

Advantageously, the head 41 of the damping device 4 comprises cutouts 410 configured to fit with the shape of the axial support extensions 381, so as to promote the limitation of tangential movements of the damping device 4 during operation.

Such extensions 381 also promote the stiffness of the tangential coupling between the fan 2 and the low-pressure compressor 3.

In another embodiment, the ferrule 38 comprises a fixing collar 380.

With reference to FIGS. 4*a*, 4*c* and 4*e*, the damping device 4 is then attached to the fixing collar 380 by means of an attachment foot 43. Advantageously, the attachment foot 43 is formed of a sheet metal piece, preferably elastic, bent for example by stamping. The attachment foot 43 has a generally elongated shape, that of a preferably planar strip, of which the elongation axis has a more or less inclined orientation with respect to the longitudinal axis of the turbomachine, once mounted in the assembly 1. This inclination of the attachment foot 43 allows positioning the support surface 40 accurately against the platform 25 of the blade 20 during assembly. In addition, adequate dimensioning of the tangential thickness of the strip, for example by increasing this thickness, allows improving the coupling between the fan 2 and the low-pressure compressor 3.

Advantageously, the attachment foot 43 also comprises one or more openings 431 cooperating with attachments 382, bolted for example, of the fixing collar, so as to attach the attachment device 4 to the ferrule 38 of the second module 3. The fixing collar 380 then extends from the knife edge seals 36 to the drum 32 in a substantially radial manner, with respect to the turbomachine longitudinal axis X-X.

Even more advantageously, with reference to FIG. 4*d*, the assembly 1 comprises an abutment 383 attached to the attachment 382, so as to limit the axial movements of the damping device 4 during operation. As can be seen in FIG. 4*d*, the bolted connection 382 participates with the attachment foot 43 connected by bolts to the fixing collar 380. The abutment 383 promotes coupling between the fan 2 and the low-pressure compressor 3, by limiting the movements of the damping device 4.

Alternatively, with reference to FIGS. 5*a* and 5*b*, the damping device 4 is attached to the fixing collar 380 by means of a lug 45 configured to cooperate with an opening 384 of the fixing collar 380. The fixing collar 380 then extends from the ferrule 38 to the platform 25, substantially axially with respect to the turbomachine longitudinal axis X-X. The control of tangential coupling between the fan 2 and the low-pressure compressor 3 is thus accomplished by dimensioning the thickness of the head 41 and of the lug 45 of the damping device 4.

In another embodiment, with reference to FIG. 4*e*, the assembly 1 comprises a plurality of damping devices 4 connected to one another, and attached together to the fixing collar, in the form of a block or angular sector 400. Advantageously, the set of damping devices 4 constitutes a ring 400 centered on the turbomachine longitudinal axis. The attachment feet 43 are then attached, for example by welding, to a mounting flange 430 connected to the attachments 382, for example by bolting. The ring 400 can thus be assembled to the ferrule 38 during assembly, to simplify the process.

Different embodiments of the assembly 1 according to the invention have been described for the case where the first rotor module 2 is a fan, and the second rotor module 3 is a low-pressure compressor.

This, however, is not limiting, because the first rotor module 2 can also be a first compressor stage, high or low pressure, and the second rotor module 3 a second stage of said compressor, high or low pressure, successive to the first compressor stage, upstream or downstream of the latter. Alternatively, the first rotor module 2 is a first turbine stage, high or low pressure, and the second rotor module 3 a second stage of said turbine, successive to the first turbine stage, upstream or downstream of the latter.

The invention claimed is:

1. An assembly for a turbomachine comprising:

a first rotor module comprising:

a disk centered on a turbomachine longitudinal axis, the disk having an external periphery and including a recess;

a first blade mounted on the external periphery of the disk from which it extends, the first blade having a first length and further comprising an airfoil, a platform having an internal surface, a support and a root embedded in the recess of the disk;

a second rotor module connected to the first rotor module and comprising a second blade having a second length smaller than the first length, the second rotor module further comprising:

a drum comprising a circumferential extension extending toward the platform of the first blade;

a ferrule which is distinct from the drum, the ferrule being attached to the circumferential extension of the drum;

a damping device having a downstream portion fixedly attached to the ferrule, the damping device further having an upstream external surface supported with friction against the internal surface of the platform of the first rotor module to couple the first rotor module and the second rotor module for damping their respective vibrational movements.

2. The assembly according to claim 1, wherein the damping device comprises a head comprising a sacrificial plate that comprises a coating defining the upstream external surface.

3. The assembly according to claim 2, wherein the coating is of the dissipative type.

4. The assembly according to claim 2, wherein the coating is of the viscoelastic type.

5. The assembly according to claim 1, wherein the damping device comprises bores designed to lighten the damping device.

6. The assembly according to claim 1, wherein the damping device comprises inserts designed to weight down the damping device.

7. The assembly according to claim 1, wherein the ferrule comprises axial extensions forming a support so as to limit tangential movements of the damping device.

8. The assembly according to claim 7, wherein the damping device comprises a head having cutouts configured to fit with a shape of the axial extensions so as to promote limitation of tangential movements of the damping device.

9. The assembly according to claim 1, wherein the ferrule comprises a fixing collar.

10. The assembly according to claim 9, wherein the damping device comprises an attachment foot connected to the fixing collar by a bolted connection.

11. The assembly according to claim 10, further comprising an abutment attached to the bolted connection to limit axial movements of the damping device.

12. The assembly according to claim 9, wherein the fixing collar comprises an opening, the damping device comprising a lug configured to cooperate with the opening so as to attach the damping device to the fixing collar.

13. The assembly according to claim 9, further comprising a plurality of damping devices connected to one another and attached together to the fixing collar in the form of an angular sector.

14. The assembly according to claim 13, wherein the plurality of damping devices constitutes a ring centered on the turbomachine longitudinal axis.

15. The assembly according to claim 1, wherein the first rotor module is a fan, and the second rotor module is a low-pressure compressor.

* * * * *